United States Patent [19]

Musacchia

[11] 4,218,084

[45] Aug. 19, 1980

[54] ADJUSTABLE DOOR STRIKE

[76] Inventor: Raymond F. Musacchia, 427 Spencer Ave., New Orleans, La. 70124

[21] Appl. No.: 23,465

[22] Filed: Mar. 23, 1979

[51] Int. Cl.[2] ..... E05C 13/00

[52] U.S. Cl. ..... 292/341.19

[58] Field of Search ..... 292/340, 341, 341.18, 292/341.19

[56] References Cited

U.S. PATENT DOCUMENTS

| | | | |
|---|---|---|---|
| 1,238,924 | 9/1917 | Kennedy | 292/341.19 |
| 2,902,308 | 9/1959 | Moberg | 292/307 R |

*Primary Examiner*—Richard E. Moore

[57] ABSTRACT

An adjustable door strike to correct for misalignment of doors is disclosed. A metal strike is fitted with break-away/pop-off tabs to expand the hole in said strike thereby providing for hole adjustment and door realignment.

2 Claims, 3 Drawing Figures

A-A

ADJUSTABLE DOOR STRIKE

FIELD OF THE INVENTION

The instant invention provides a new door strike thereby providing for alignment of doors.

SUMMARY OF INVENTION

An adjustable door strike to correct for misalignment between doors and door frame comprising a vertical base plate, a hole along one edge of said base plate for receiving door lock bolt, and a plurality of pop-off/break-away tabs designed to break-away/pop-off thus expanding said hole in said base plate is disclosed. The break-away/pop-off tabs are fitted to said base plate hole by means of either perforations or grooves and can be easily removed or popped away without removing the door strike. The instant invention provides a means to correct problems in most buildings which suffer from settling or any other reason for misalignment. Since nothing in the prior art provides a means of adjusting the door strike without removing the strike for adjusting, the instant invention is a significant improvement of the art. The instant invention satisfies the need of adjustment without removal of the strike by the simple method of expanding the hole by means of break-away/pop-off tabs.

PRIOR ART OR BACKGROUND

A door strike is used to protect the door frame from damage or marring as a result of being constantly struck by the latch bolt of the door lock every time the door is closed. While protecting the door frame from damage, the door strike also serves as a guide for the latch bolt to enter the hole in the door frame and thereby securely hold the door shut.

A simple door strike is usually made of metal with a bevelled striking edge, holes for screws so that it can be attached to the door frame and an opening or hole in its middle to accept the latch bolt of the lock. In the event the latch bolt cannot enter the hole in the door strike for any reason, then the door cannot be locked. In order to correct this problem, it is necessary to remove the strike from the door frame, notch out the opening in the door frame and replace the door strike. The door frame is then marred or damaged with an unnecessary opening and the screws used to attach the door strike to the door frame cannot securely grip the door frame because they line up with the old opening in the frame. The result of this "old fashioned" realignment is usually very time consuming and expensive.

DETAILED DESCRIPTION OF INVENTION

Figure 1:
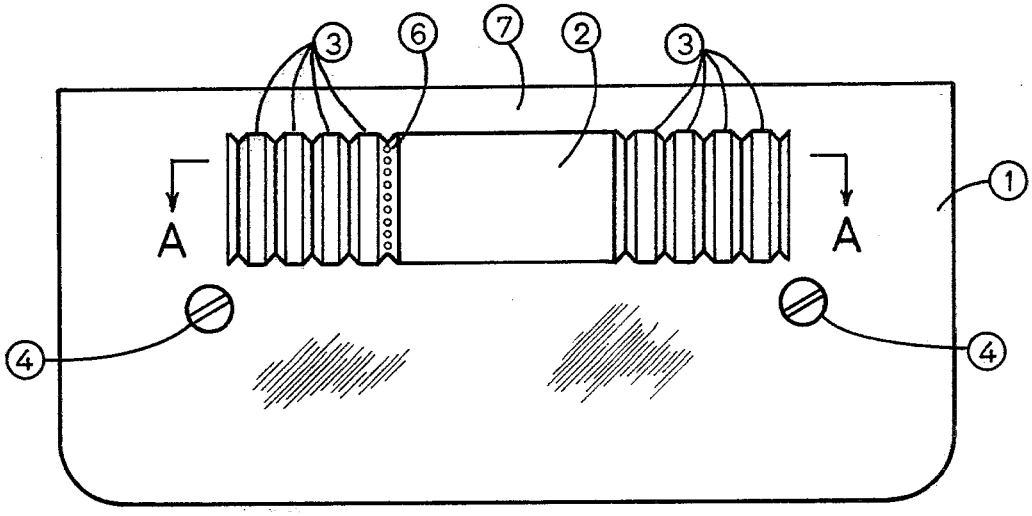
FIG. 1 is a top view of the adjustable door strike.

Referring to FIG. 1 wherein reference number 1 is a base plate usually installed along its vertical axis on a door. This base plate is made of any material. It can be wood, plastic, metal, etc. However, in the instant invention the base plate is metal. Base plate 1 has a hole 2.

Figure 3:
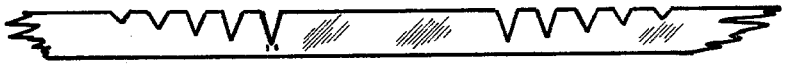
FIG. 3 is a detail of the pop-off/break-away tabs describing a grooved type embodiment.

Hole 2 is located along one vertical edge of the plate except for a metal shoulder 7 which must be provided for structural support. Shoulder 7 will be designed in width and thickness to correctly provide for proper hole 2 sizing. Hole 2 is fitted with break-away/pop-off tabs 3. Pop-off/break-away tabs 3 are designed to break-off/pop-off. These pop-off/break-away tabs can be fitted by any means to break-away/pop-off. However, in the instant invention metal break-off/pop-off tabs 3 were made by means of perforation 6. Break-away or pop-off can be accomplished by any mechanical leverage to break-away/pop-off tabs 3, but in the instant invention pliers were used to break-away/pop-off tabs 3. Tabs 3 can be either perforated, grooved as in FIG. 3, or scored or a combination of either. Break-away/pop-off tabs 3 FIG. 1 are fitted along the horizontal axis and are designed to be as long as the width of hole 2, as thick as a metal base 1 and as wide as desired to vertically increase hole 2. Therefore, a plurality of break-away/-pop-off tabs 3 can be provided and is limited only by the size of base plate 1. Suffice it to say that pop-off/break-away tabs 3 can be removed in any fashion in increasing the size of hole 2. That is, hole 2 can either be extended only on the top or on the bottom or in both directions. Thus, the perforations are located by means of the design parameter determining the amount one desires to increase hole 2 in either direction and the perforations will be made along the horizontal edge of tabs 3 in the spot desired for breaking-away/ popping-off. Furthermore, if a groove is desired for fitting break-away/pop-off tabs 3 then the same parameter of locating the groove along the edge to be popped-off/broken-away on the horizontal is followed. In the case of grooving, the groove nearest the hole should be slightly deeper than each succeeding groove. This will give structural support to the remaining tabs 3 FIG. 3 which are not to be removed. Therefore, hole 2 FIG. 1 can be adjusted for movement in the vertical direction simply by the breaking-away/popping-off as many of tabs 3 as necessary for hole 2 enlargement.

Figure 2:
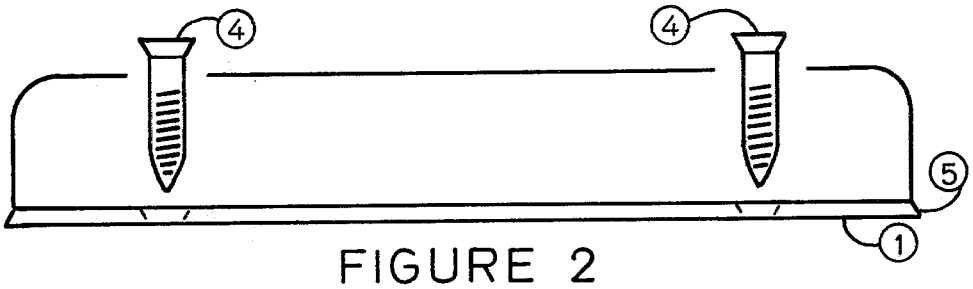
FIG. 2 is an end view of the adjustable door strike showing the bevelled edges, and method of attachment to a door.

Screws 4 FIG. 2 are provided to attach base plate 1 to any door frame. The number of screws is not important, only sufficient screws must be provided to make a secure attachment and it may be necessary to counter sink the holes of screws 4 to provide for flush mounting. Base plate 1 must be bevelled along striking edge 5, FIG. 2. This will allow for a door to close without hanging up on any sharp striking edge.

I claim:

1. An adjustable door strike to correct for misalignment between doors and door frames, comprising:
   (a) a vertical base plate;
   (b) a hole located along one edge of said base plate, said hole for receiving a door lock bolt;
   (c) a plurality of pop-off/break-away tabs juxtaposed to said hole, said tabs designed to break-away/pop-off to expand said hole or opening in said base plate, said tabs fitted with grooves along a horizontal edge in the spot desired for breaking-away/popping-off and each said groove successively grooved slightly deeper than each succeeding groove, the deepest groove being nearest the hole.

2. The adjustable door strike of claim 1 wherein said break-away/pop-off tabs are perforated along the horizontal edge in the desired spot for breaking away.

* * * * *